US008907020B2

(12) United States Patent
Tsunashima et al.

(10) Patent No.: US 8,907,020 B2
(45) Date of Patent: Dec. 9, 2014

(54) GOLF BALL

(75) Inventors: Hiromasa Tsunashima, Kobe (JP); Yumi Kanemitsu, Kobe (JP); Kazuhisa Fushihara, Kobe (JP); Mikio Yamada, Kobe (JP)

(73) Assignee: SRI Sports Limited, Kobe (JP)

( * ) Notice: Subject to any disclaimer, the term of this patent is extended or adjusted under 35 U.S.C. 154(b) by 364 days.

(21) Appl. No.: 13/303,293

(22) Filed: Nov. 23, 2011

(65) Prior Publication Data

US 2012/0149496 A1 Jun. 14, 2012

(30) Foreign Application Priority Data

Dec. 14, 2010 (JP) ..... 2010-278258

(51) Int. Cl.

| | |
|---|---|
| ***A63B 37/06*** | (2006.01) |
| ***A63B 37/00*** | (2006.01) |
| ***C08K 5/37*** | (2006.01) |
| ***C08K 5/375*** | (2006.01) |
| ***C08L 9/00*** | (2006.01) |

(52) U.S. Cl.

CPC ..... *A63B 37/0073* (2013.01); *A63B 37/0074* (2013.01)

USPC ..... 525/261; 525/274; 524/289; 524/392; 473/371; 473/377

(58) Field of Classification Search

None

See application file for complete search history.

(56) References Cited

U.S. PATENT DOCUMENTS

| | | | | |
|---|---|---|---|---|
| 7,358,309 | B2 | 4/2008 | Sullivan et al. | |
| 7,888,417 | B2 | 2/2011 | Sullivan et al. | |
| 2003/0050136 | A1 | 3/2003 | Mano et al. | |
| 2003/0064827 | A1 | 4/2003 | Sakagami et al. | |
| 2003/0130396 | A1 | 7/2003 | Voorheis et al. | |
| 2003/0144427 | A1 | 7/2003 | Mano | |
| 2004/0106475 | A1* | 6/2004 | Sasaki et al. | 473/371 |
| 2005/0137344 | A1 | 6/2005 | Voorheis | |
| 2005/0202902 | A1 | 9/2005 | Ohama et al. | |
| 2005/0245652 | A1* | 11/2005 | Bulpett et al. | 524/289 |
| 2007/0213441 | A1 | 9/2007 | Comeau et al. | |
| 2008/0214739 | A1 | 9/2008 | Voorheis | |
| 2008/0227567 | A1 | 9/2008 | Sullivan et al. | |

FOREIGN PATENT DOCUMENTS

| | | | |
|---|---|---|---|
| JP | 2001-327629 | A | 11/2001 |
| JP | 2002-224243 | A | 8/2002 |
| JP | 2002-338752 | A | 11/2002 |
| JP | 2003-33447 | A | 2/2003 |
| JP | 2003-38682 | A | 2/2003 |
| JP | 2003-164545 | A | 6/2003 |
| JP | 2004-181244 | A | 7/2004 |
| JP | 2005-177511 | A | 7/2005 |
| JP | 2005-218618 | A | 8/2005 |
| JP | 2007-007427 | A | 1/2007 |
| JP | 2007-252900 | A | 10/2007 |

OTHER PUBLICATIONS

English language translation of Japanese Office Action dated Jul. 29, 2014 for U.S. Appl. No. 2010-278258.

* cited by examiner

*Primary Examiner* — David Buttner

(74) *Attorney, Agent, or Firm* — Birch, Stewart, Kolasch & Birch, LLP

(57) ABSTRACT

An object of the present invention is to provide a golf ball having high resilience. The present invention provides a golf ball having a constituting member, wherein at least a part of the constituting member is formed from a rubber composition containing (a) a base rubber, (b) a co-crosslinking agent, (c) a crosslinking initiator, and (d) an organic sulfur compound, the organic sulfur compound being derivatives of thiophenols and disulfide with a strong electron withdrawing substituent.

13 Claims, No Drawings

GOLF BALL

FIELD OF THE INVENTION

The present invention relates to a golf ball having high resilience, more particularly to a technology for improving a golf ball rubber composition.

DESCRIPTION OF THE RELATED ART

The cured products of the rubber composition having high resilience are used for cores of the golf ball or one-piece golf ball bodies. The rubber composition contains, for example, a base rubber, a co-crosslinking agent, a crosslinking initiator. It is known that an organic sulfur compound is added to the rubber composition in order to further improve the resilience.

Japanese Patent Publication No. 2003-38682 A discloses a solid golf ball consisting of at least one core layer and at least one cover layer formed to cover the core, wherein at least one layer of the core is formed by vulcanizing and molding a rubber composition containing (a) a base rubber, (b) a co-crosslinking agent, (c) an organic peroxide, (d) barium sulfate, and (e) fluorine substituted thiophenol having a specific structure and/or monovalent or divalent metal salt thereof. Japanese Patent Publication No. 2001-327629 A discloses a solid golf ball in which at least one layer of a core is formed by vulcanizing and molding a rubber composition which contains a base rubber, a co-crosslinking agent, an organic peroxide, a filler, and a specific organic sulfur compound having a substituent with a substituent constant of 1.42 or more. Japanese Patent Publication No. 2002-338752 A discloses a solid golf ball in which at least one layer of a core is formed by vulcanizing and molding a rubber composition which contains a base rubber, a co-crosslinking agent, an organic peroxide, and tribromothiophenol, tetrabromothiophenol, or a monovalent or bivalent metal salt of the thiophenols. Japanese Patent Publication No. 2003-033447 A discloses a solid golf ball in which at least one layer of a core is formed by vulcanizing and molding a rubber composition which contains a base rubber, a co-crosslinking agent, an organic peroxide, and a disulfide compound which includes at least one member selected from bis(bromophenyl)disulfide, bis(dibromophenyl)disulfide, bis(tribromophenyl)disulfide, bis(tetrabromophenyl)disulfide, and bis(pentabromophenyl) disulfide. A deformation amount of the core when applying a load from 98N as an initial load to 1275 N as a final load to the core, is 3.54 mm to 6.0 mm.

Japanese Patent Publication No. 2002-224243 A discloses a solid golf ball comprising a core consisting of a vulcanized product of a rubber composition containing a base rubber, an α,β-unsaturated carboxylic acid and/or a metal salt thereof, an organic peroxide, an inorganic metal salt, a benzoyl disulfide or derivative thereof having a specific structure, or a multi-layered core having at least one layer consisting of the vulcanized product, and a single-layered or multi-layered cover formed over the core. Japanese Patent Publication Nos. 2004-181244 A and 2005-177511 A disclose a golf ball having at least one constituting layer formed from a composition containing a halogenated organic sulfur compound having a specific structure.

Japanese Patent Publication No. 2005-218618 A discloses a solid golf ball comprising at least one core layer, and at least one cover layer formed on the core, wherein the core is formed from a rubber composition containing a base rubber, a co-crosslinking agent, an organic peroxide, and an organic sulfur compound, and the base rubber contains a polybutadiene synthesized using a rare-earth element-containing catalyst, and the organic sulfur compound includes a polysulfide compound having bromo group. Japanese Patent Publication No. 2007-252900 A discloses a golf ball comprising at least one layer formed from a rubber composition containing (a) a base rubber, (b) a free radical initiator, and (c) a quinhydrone.

Japanese Patent Publication No. 2003-164545 A discloses a golf ball, wherein at least one layer of a core is formed from a rubber composition containing a base rubber, a co-crosslinking agent, a vulcanization initiator, a filler and an organic sulfur compound including a thiophenol or derivative thereof, diphenyldisulfide or derivative thereof. The thiophenol or derivative thereof and diphenyldisulfide or derivative thereof have a substituent group selected from the group consisting of halogen group (F, Cl, Br, I), alkyl group, carboxyl group (—COOH) or ester thereof (—COOR), formyl group (—CHO), acyl group (—COR), halogenated carbonyl group (—COX), sulfo group (—$SO_3H$) or ester thereof (—$SO_3R$), halogenated sulfonyl group (—$SO_2X$), sulfino group (—$SO_2H$), alkylsulfinyl group (—SOR), carbamoyl group (—$CONH_2$), halogenated alkyl group, cyano group (—CN), alkoxy group (—OR), and combination thereof.

SUMMARY OF THE INVENTION

An object of the present invention is to provide a golf ball having high resilience.

The present invention that has solved the above problem provides a golf ball having a constituting member, wherein at least one part of the constituting member is formed from a rubber composition containing (a) a base rubber, (b) a co-crosslinking agent, (c) a crosslinking initiator, and (d) an organic sulfur compound including at least one represented by following formulae (1) to (3).

(1)

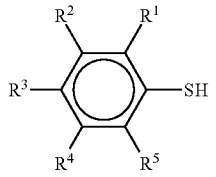

(In formula (1), $R^1$ to $R^5$ each independently represent $COOR^{11}$ or H, and at least one of $R^1$ to $R^5$ is $COOR^{11}$. $R^{11}$ is an electron withdrawing group having at least one member selected from the group consisting of a carbonyl group, a halogen atom, and an alkyl halide group.)

(2)

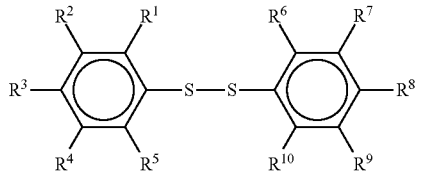

(In formula (2), $R^1$ to $R^{10}$ each independently represent $COOR^{11}$ or H, and at least one of $R^1$ to $R^5$ and at least one of $R^6$ to $R^{10}$ are $COOR^{11}$. $R^{11}$ is an electron withdrawing group having at least one member selected from the group consisting of a carbonyl group, a halogen atom, and an alkyl halide group.)

(3)

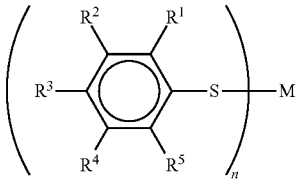

(In formula (3), $R^1$ to $R^5$ each independently represent $COOR^{11}$ or H, and at least one of $R^1$ to $R^5$ is $COOR^{11}$. $R^{11}$ is an electron withdrawing group having at least one member selected from the group consisting of a carbonyl group, a halogen atom, and an alkyl halide group. n is a natural number equal to or larger than 1, and M represents a metal atom having a valence equal to or larger than 1.)

The inventors of the present invention have studied a relationship between the structure of the organic sulfur compounds like thiophenols and diphenyldisulfide that are added to the rubber composition and the resilience, and have made the present invention based on the following findings. The substituents attached to the aromatic ring of the organic sulfur compounds like thiophenols and diphenyldisulfide do not influence the generation of radicals from the organic sulfur compound, but influence the control of a crosslinking reaction which takes place between the base rubber and the co-crosslinking agent. In other words, as a result of the substituents being attached to the aromatic ring, the stability of a transition state formed during the reaction of the organic sulfur compound with the base rubber and the co-crosslinking agent, changes, and thus the activation energy which influences the reaction changes. And, it is considered that the stability of the transition state depends upon the electron density of the sulfur atom of the organic sulfur compound. If the substituent having a large effect on electron delocalization is attached, the activation energy of the reaction becomes small and thus the reactivity is enhanced. The substituent $COOR^{11}$ attached to the aromatic ring of the organic sulfur compounds represented by the formulae (1) to (3) used in the present invention, are derivatives of the carboxyl group. The substituent $COOR^{11}$ is a strong electron withdrawing group, since it does not only have an inductive effect to withdraw electrons but also has an action of withdrawing electrons by resonance with the aromatic ring. As a result, the reactivity between the co-crosslinking agent and the rubber molecule improves, and the resilience of the cured product of the resultant rubber composition also improves.

According to the present invention, it is possible to provide a golf ball having high resilience.

DESCRIPTION OF THE PREFERRED EMBODIMENT

The present invention provides a golf ball having a constituting member, wherein at least one part of the constituting member is formed from a rubber composition containing (a) a base rubber, (b) a co-crosslinking agent, (c) a crosslinking initiator, and (d) an organic sulfur compound including at least one represented by following formulae (1) to (3).

(1)

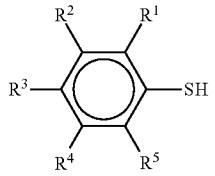

(In formula (1), $R^1$ to $R^5$ each independently represent $COOR^{11}$ or H, and at least one of $R^1$ to $R^5$ is $COOR^{11}R^{11}$ is an electron withdrawing group having at least one member selected from the group consisting of a carbonyl group, a halogen atom, and an alkyl halide group.)

(2)

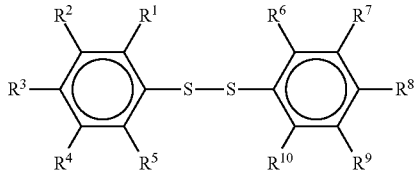

(In formula (2), $R^1$ to $R^{10}$ each independently represent $COOR^{11}$ or H, and at least one of $R^1$ to $R^5$ and at least one of $R^6$ to $R^{10}$ are $COOR^{11}$. $R^{11}$ is an electron withdrawing group having at least one member selected from the group consisting of a carbonyl group, a halogen atom, and an alkyl halide group.)

(3)

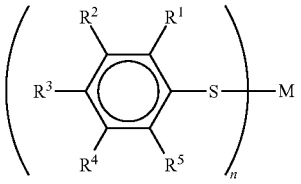

(In formula (3), $R^1$ to $R^5$ each independently represent $COOR^{11}$ or H, and at least one of $R^1$ to $R^5$ is $COOR^{11}$. $R^{11}$ is an electron withdrawing group having at least one member selected from the group consisting of a carbonyl group, a halogen atom, and an alkyl halide group. n is a natural number equal to or larger than 1, and M represents a metal atom having a valence equal to or larger than 1.)

First, (d) the organic sulfur compound used in the present invention will be explained. (d) The organic sulfur compound includes at least one represented by the above formulae (1) to (3).

In the organic sulfur compound represented by the formula (1), $R^1$ to $R^5$ each independently represent $COOR^{11}$ or H, and at least one of $R^1$ to $R^5$ is $COOR^{11}$. The organic sulfur compound represented by the formula (1) is not limited, as long as at least one of $R^1$ to $R^5$ is $COOR^{11}$. It is preferable that two to four substituents of $R^1$ to $R^5$ are $COOR^{11}$, and it is more preferable that three substituents of $R^1$ to $R^5$ are $COOR^{11}$. If the number of the substituents is small, the reactivity between the base rubber and the co-crosslinking agent may become low due to the small electron withdrawing effect. If the number of the substituents is large, in the case of the bulky $COOR^{11}$, the reactivity between the base rubber and the co-crosslinking agent may become low, because the steric hindrance occurs within the molecule.

The position of the electron withdrawing group $COOR^{11}$ of the organic sulfur compound represented by the above formula (1) is appropriately determined, taking account of the inductive effect, resonance effect, steric hindrance, and the like. The position of the electron withdrawing group $COOR^{11}$ is most preferably ortho position, followed by para position and meta position in this order. Accordingly, it is preferable that at least one of $R^1$, $R^3$, and $R^5$ attached at ortho position and para position to the sulfur bond is $COOR^{11}$. In the case of incorporating a plurality of electron withdrawing groups $COOR^{11}$, it is preferable to provide a space between the electron withdrawing groups $COOR^{11}$ in order to lower the influence of the steric hindrance. Preferable examples of the organic sulfur compounds represented by the formula (1) are the organic sulfur compounds where two electron withdrawing groups $COOR^{11}$ exist at ortho-para positions, ortho-ortho positions, or meta-meta positions, or the organic sulfur compounds where three electron withdrawing groups $COOR^{11}$ exist at ortho-ortho-para positions.

The organic sulfur compound represented by the formula (3) includes, for example, metal salts of the organic sulfur compounds represented by the formula (1). With respect to the organic sulfur compound represented by the above formula (3), n is a natural number equal to or larger than 1, preferably a natural number of 1 to 4. M is a metal atom having a valance equal to or larger than 1, preferably a monovalent to tetravalent metal atom. Among them, the organic sulfur compound where n=1 and M is a monovalent metal atom or the organic sulfur compound where n=2 and M is a divalent metal atom is preferable. The valence number of the metal atom generally corresponds to the number of n. The monovalent metal atom represented by M includes, for example, sodium, lithium, potassium, copper (I), silver (I) or the like. The divalent metal atom includes, for example, zinc, magnesium, calcium, strontium, barium, titanium (II), manganese (II), iron (II), cobalt (II), nickel (II), zirconium (II), tin (II) or the like. The trivalent metal atom includes, for example, aluminum (III), iron (III) or the like. The tetravalent metal atom includes, for example, titanium (IV), zirconium (IV) or the like.

In the organic sulfur compound represented by formula (2), $R^1$ to $R^{10}$ each independently represent $COOR^{11}$ or H, and at least one of $R^1$ to $R^5$ and at least one of $R^6$ to $R^{10}$ are $COOR^{11}$. In the organic sulfur compound represented by formula (2), at least one of $R^1$ to $R^5$ and at least one of $R^6$ to $R^{10}$ may be the electron withdrawing groups $COOR^{11}$. Preferably, two to four substituents of $R^1$ to $R^5$ and two to four substituents of $R^6$ to $R^{10}$ are the electron withdrawing groups $COOR^{11}$. More preferably, three substituents of $R^1$ to $R^5$ and three substituents of $R^6$ to $R^{10}$ are the electron withdrawing groups $COOR^{11}$. If the number of the substituents is too small, the reactivity between the base rubber and the co-crosslinking agent may become low due to the small electron delocalization effect. If the number of the substituents is too large, in the case of the bulky $COOR^{11}$, the reactivity between the base rubber and the co-crosslinking agent may become low, because the steric hindrance occurs within the molecule.

In the organic sulfur compound represented by the above described formula (2), as described for the organic sulfur compound of formula (1), the position of the electron withdrawing group $COOR^{11}$ is preferably set as appropriate. The organic sulfur compound represented by formula (2) may include, for example, an organic sulfur compound in which four substituents $COOR^{11}$ exist at ortho-para, ortho-ortho, or meta-meta positions, or an organic sulfur compound in which six substituents $COOR^{11}$ exist at ortho-ortho-para positions.

In a more preferable embodiment of the present invention, organic sulfur compounds represented by the following formulae (4) to (6) are used as the organic sulfur compound (d) in order to balance steric hindrance and electron delocalization effect.

(4)

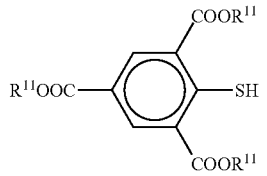

(5)

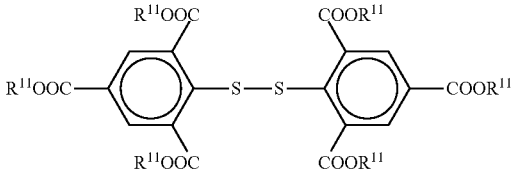

(6)

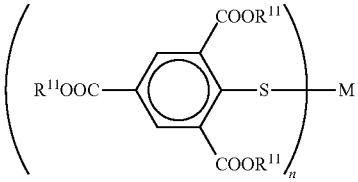

In formulae (4) to (6), $R^{11}$ is an electron withdrawing group having at least one member selected from the group consisting of a carbonyl group, a halogen atom, and an alkyl halide group. In formula (6), n is a natural number equal to or larger than 1, and M represents a metal atom having a valence equal to or larger than 1.

In the organic sulfur compounds represented by formula (1) to (6) for use in the present invention, $R^{11}$ in the electron withdrawing group $COOR^{11}$ represents an electron withdrawing group having at least one member selected from the group consisting of a carbonyl group, a halogen atom, and an alkyl halide group. The electron withdrawing group $COOR^{11}$ is a derivative of a carboxyl group and has electron withdrawing ability by itself (at the COO part). However, the electron withdrawing group $COOR^{11}$ has a further enhanced electron withdrawing effect by further having an electron withdrawing substituent at the $R^{11}$ part. As the $R^{11}$, an electron withdrawing group having a carbonyl group is preferable.

Specific examples of the electron withdrawing group $R^{11}$ may include, for example, COX (X is any one of Br, Cl, or F), and $COR^{12}$ ($R^{12}$ is an alkyl group that may be substituted). As the COX, COCl (chloroformyl) group is preferable. As the alkyl group $R^{12}$, for example, an alkyl group having a carbon number of 1 to 17 is preferable, and an alkyl group having a carbon number of 1 to 4 is more preferable. Specific examples of the alkyl group $R^{12}$ may include methyl group, ethyl group, propyl group, butyl group, pentyl group, hexyl group, heptyl group, octyl group, nonyl group, decyl group, undecyl group, dodecyl group, tridecyl group, and the like. The alkyl group $R^{12}$ may be a straight chain or may be branched.

In the alkyl group $R^{12}$, a part of the hydrogen atoms included in the alkyl group may be substituted. An electron withdrawing substituent is preferable as a substituent for substituting a part of the hydrogen atoms. This is because attachment of an electron withdrawing substituent results in delocalization of electron density of the organic sulfur compound. The electron withdrawing substituent for substituting a part of the hydrogen atoms includes, for example, a halogen atom and a nitrile group. As the halogen atom, Br, Cl, F, and the like are suitable. Specific examples of the alkyl group $R^{12}$, in which a part of the hydrogen atoms included in the alkyl group is substituted, include tribromomethyl group, trichloromethyl group, trifluoromethyl group, pentabromoethyl group, pentachloroethyl group, pentafluoroethyl group, heptabromopropyl group, heptachloropropyl group, heptafluoropropyl group, and the like.

The electron withdrawing group $R^{11}$ may be an alkyl halide group. The alkyl halide group includes one that is identical to the alkyl group $R^{12}$ in which a part of the hydrogen atoms included in the alkyl group is substituted with a halogen atom.

Specific examples of the organic sulfur compound represented by the formula (1) include 2,4,6-tris(chloroformylcarboxy)thiophenol, 2,6-bis(chloroformylcarboxy)thiophenol, 2,3,4-tris(chloroformylcarboxy)thiophenol, pentakis(chloroformylcarboxy)thiophenol, 2,4,6-tris(acetoxycarbonyl)thiophenol, 2,6-bis(acetoxycarbonyl)thiophenol, 2,3,4-tris(acetoxycarbonyl)thiophenol, pentakis(acetoxycarbonyl)thiophenol, 2,4,6-tris(trifluoromethylcarboxy)thiophenol, 2,4,6-tris(trichloromethycarboxy)thiophenol, 2,4,6-tris(tribromomethylcarboxy)thiophenol, and 2,4,6-tris(trichloromethylformylcarboxy)thiophenol.

Specific examples of the organic sulfur compound represented by the formula (2) include bis(2,4,6-tris(chloroformylcarboxy)phenyl)disulfide, bis(2,6-bis(chloroformylcarboxy)phenyl)disulfide, bis(2,3,4-tris(chloroformylcarboxy)phenyl)disulfide, bis(pentakis(chloroformylcarboxy)phenyl)disulfide, bis(2,4,6-tris(acetoxycarbonyl)phenyl)disulfide, bis(2,6-bis(acetoxycarbonyl)phenyl)disulfide, bis(2,3,4-tris(acetoxycarbonyl)phenyl)disulfide, bis(pentakis(acetoxycarbonyl)phenyl)disulfide, bis(2,4,6-tris(trifluoromethylcarboxy)phenyl)disulfide, bis(2,4,6-tris(trichloromethylcarboxy)phenyl)disulfide, bis(2,4,6-tris(tribromomethylcarboxy)phenyl)disulfide, and bis(2,4,6-tris(trichloromethylformylcarboxy)phenyl)disulfide.

The organic sulfur compound represented by the formula (3) includes, for example, metal salts of the organic sulfur compounds represented by the formula (1). The metal salts includes, for example, a zinc salt, a magnesium salt, a sodium salt or the like, more preferably a zinc salt.

The blending amount of (d) the organic sulfur compound is preferably 0.05 part by mass or more, and more preferably 0.1 part by mass or more, and is preferably 3.0 parts by mass or less, and more preferably 2.0 parts by mass or less, with respect to 100 parts by mass of (a) the base rubber. If the blending amount of (d) the organic sulfur compound is less than 0.05 part by mass, the effect of addition of (d) the organic sulfur compound may not be obtained, and thus the resilience of the resultant golf ball may not be improved. On the other hand, if the blending amount of (d) the organic sulfur compound exceeds 3.0 parts by mass, the compression deformation amount of the resultant golf ball may become large, resulting in lower resilience.

As (a) the base rubber used in the present invention, natural rubber and/or synthetic rubber can be used. For example, polybutadiene rubber, natural rubber, polyisoprene rubber, styrene polybutadiene rubber, ethylene-propylene-diene rubber (EPDM), or the like can be used. These rubbers may be used solely or two or more of these rubbers may be used in combination. Among them, typically preferred is the high cis-polybutadiene having cis-1,4 bond in a proportion of 40 mass % or more, more preferably 80 mass % or more, even more preferably 90 mass % or more in view of its superior resilience property.

The high-cis polybutadiene preferably has 1,2-vinyl bonds in a content of 2 mass % or less, more preferably 1.7 mass % or less, and even more preferably 1.5 mass % or less. If the content of 1,2-vinyl bonds is excessively high, the resilience may be lowered.

The high-cis polybutadiene is preferably one synthesized using a rare earth element catalyst. When a neodymium catalyst, which employs a neodymium compound which is a lanthanum series rare earth element compound, is used, a polybutadiene rubber having a high content of cis-1,4 bonds and a low content of 1,2-vinyl bonds is obtained with excellent polymerization activity. Such a polybutadiene rubber is particularly preferred.

The high-cis polybutadiene preferably has a Mooney viscosity ($ML_{1+4}$ (100° C.)) of 30 or more, more preferably 32 or more, even more preferably 35 or more, and most preferably 40 or more, and preferably has a Mooney viscosity ($ML_{1+4}$ (100° C.)) of 140 or less, more preferably 120 or less, even more preferably 100 or less, and most preferably 80 or less. It is noted that the Mooney viscosity ($ML_{1+4}$ (100° C.)) in the present invention is a value measured according to JIS K6300 using an L rotor under the conditions of: a preheating time of 1 minute; a rotor revolution time of 4 minutes; and a temperature of 100° C.

The high-cis polybutadiene preferably has a molecular weight distribution Mw/Mn (Mw: weight average molecular weight, Mn: number average molecular weight) of 2.0 or more, more preferably 2.2 or more, even more preferably 2.4 or more, and most preferably 2.6 or more, and preferably has a molecular weight distribution Mw/Mn of 6.0 or less, more preferably 5.0 or less, even more preferably 4.0 or less, and most preferably 3.4 or less. If the molecular weight distribution (Mw/Mn) of the high-cis polybutadiene is excessively low, the processability deteriorates. If the molecular weight distribution (Mw/Mn) of the high-cis polybutadiene is excessively high, the resilience may be lowered. It is noted that the measurement of the molecular weight distribution is conducted by gel permeation chromatography ("HLC-8120GPC", manufactured by Tosoh Corporation) using a differential refractometer as a detector under the conditions of column: GMHHXL (manufactured by Tosoh Corporation), column temperature: 40° C., and mobile phase: tetrahydrofuran, and calculated by converting, using polystyrene standard.

(b) The co-crosslinking agent is not particularly limited, as long as it has the action of crosslinking a rubber molecule by graft polymerization to a base rubber molecular chain. For example, an α,β-unsaturated carboxylic acid having 3 to 8 carbon atoms, or a metal salt thereof can be used, and preferable examples thereof include acrylic acid, methacrylic acid, and metal salts thereof. Examples of the metal for forming the metal salt include zinc, magnesium, calcium, aluminum, and sodium. As (b) the co-crosslinking agent, zinc acrylate is preferred, because the obtained golf ball has high resilience.

The blending amount of (b) the co-crosslinking agent is preferably 15 parts by mass or more, more preferably 20 parts by mass or more, and is preferably 45 parts by mass or less, and more preferably 35 parts by mass or less, with respect to 100 parts by mass of (a) the base rubber. If the blending amount of (b) the co-crosslinking agent is less than 15 parts by mass, the blending amount of (c) the crosslinking initiator, which will be described later, must be increased to have an appropriate hardness of the constituting member formed from the rubber composition. Thus, the resilience of the golf ball tends to decrease. On the other hand, if the blending amount of (b) the co-crosslinking agent exceeds 45 parts by mass, the constituting member formed from the rubber composition becomes too hard, and thus the shot feeling of the golf ball may deteriorate.

(c) The crosslinking initiator is blended in order to crosslink (a) the base rubber. As (c) the crosslinking initiator, an organic peroxide is preferred. Specific examples of the organic peroxide include organic peroxides such as dicumyl peroxide, 1,1-bis(t-butylperoxy)-3,3,5-trimethylcyclohexane, 2,5-dimethyl-2,5-di(t-butylperoxy)hexane, and di-t-butyl peroxide. These organic peroxides may be used solely or two or more of these organic peroxides may be used in combination. Among them, dicumyl peroxide is preferably used.

The blending amount of (c) the crosslinking initiator is preferably 0.2 part by mass or more, and more preferably 0.5 part by mass or more, and is preferably 5.0 parts by mass or less, and more preferably 2.5 parts by mass or less, with respect to 100 parts by mass of (a) the base rubber. If the blending amount of (c) the crosslinking initiator is less than 0.2 parts by mass, the constituting member formed from the rubber composition becomes too soft, and thus the golf ball may have the low resilience. If the blending amount of (c) the crosslinking initiator exceeds 5.0 parts by mass, the amount of (b) the co-crosslinking agent must be decreased in order to obtain the appropriate hardness of the constituting member formed from the rubber composition, which tends to cause the insufficient resilience and poor durability.

Further, the blending ratio of (d) the organic sulfur compound to (c) the crosslinking initiator ((d) organic sulfur compound/(c) crosslinking initiator) (mass ratio) is preferably 0.01 or more, and more preferably 0.1 or more, and is preferably 8.0 or less, and more preferably 3.0 or less, even more preferably 1.0 or less. If the blending ratio is less than 0.01, there is a possibility that the effect by addition of (d) the organic sulfur compound will not be obtained, and the resilience of the golf ball will not improve. On the other hand, if the blending ratio exceeds 8.0, there is a possibility that the compression deformation amount of an obtained golf ball will become large and the resilience will be lowered.

In addition to (a) the base rubber, (b) the co-crosslinking agent, (c) the crosslinking initiator, and (d) the organic sulfur compound, the rubber composition used in the present invention may contain additives, such as a pigment, a filler for adjusting specific gravity, an antioxidant, a peptizing agent, and a softener, where necessary.

Examples of the pigment blended in the rubber composition include a white pigment, a blue pigment, and a purple pigment. As the white pigment, titanium oxide is preferably used. The type of titanium oxide is not particularly limited, but rutile type is preferably used because of the high opacity. In addition, the blending amount of titanium oxide is preferably 0.5 parts by mass or more, and more preferably 2 parts by mass or more, and is preferably 8 parts by mass or less, and more preferably 5 parts by mass or less, with respect to 100 parts by mass of (a) the base rubber.

It is also preferred if the rubber composition contains both a white pigment and a blue pigment. The blue pigment is blended in order to cause white color to be vivid, and examples thereof include ultramarine blue, cobalt blue, and phthalocyanine blue. In addition, examples of the purple pigment include anthraquinone violet, dioxazine violet, and methyl violet.

The blending amount of the blue pigment is preferably 0.001 part by mass or more, and more preferably 0.05 part by mass or more, and is preferably 0.2 part by mass or less, and more preferably 0.1 part by mass or less, with respect to 100 parts by mass of (a) the base rubber. If the blending amount of the blue pigment is less than 0.001 part by mass, blueness is insufficient, and the color looks yellowish. If the blending amount of the blue pigment exceeds 0.2 part by mass, blueness is excessively strong, and a vivid white appearance is not provided.

The filler blended in the rubber composition is used as a specific gravity adjusting agent for mainly adjusting the specific gravity of a golf ball obtained as an final product so as to be in the range of 1.0 to 1.5. As the filler, any filler which is generally blended in a golf ball may be used, and examples of the filler include inorganic fillers (specifically, zinc oxide, barium sulfate, calcium carbonate, or the like), powder of a metal with a high specific gravity (e.g., tungsten powder, molybdenum powder, or the like), and mixtures thereof. Zinc oxide, which also functions as a vulcanization aid, is particularly preferred. When zinc oxide is used, the blending amount of zinc oxide is preferably 30 parts by mass or less, more preferably 25 parts by mass or less, and more preferably 20 parts by mass or less, with respect to 100 parts by mass of (a) the base rubber. If the blending amount of zinc oxide exceeds 30 parts by mass, the rubber component is reduced, and high resilience is not obtained.

The blending amount of the antioxidant is preferably 0.1 parts by mass or more and 1 part by mass or less, with respect to 100 parts by mass of (a) the base rubber. In addition, the blending amount of the peptizing agent is preferably 0.1 part by mass or more and 5 parts by mass or less, with respect to 100 parts by mass of (a) the base rubber.

The golf ball of the present invention has a constituting member, wherein at least a part of the constituting member is formed from a rubber composition containing (a) a base rubber, (b) a co-crosslinking agent, (c) a crosslinking initiator, and (d) an organic sulfur compound, wherein (d) the organic sulfur compound includes at least one organic sulfur compound represented by the above formulae (1) to (3). In a preferable embodiment, the golf ball of the present invention comprises at least one core layer and a cover covering the core, wherein at least one layer of the core is formed from the above rubber composition.

Examples of the golf ball of the present invention include a one-piece golf ball whose golf ball body is formed from the above rubber composition; a two-piece golf ball which has a core and a cover covering the core, wherein the core is formed from the above rubber composition; a multi-piece golf ball (including three-piece golf ball) which has: a core including a center and at least one intermediate layer covering the center; and a cover covering the core, wherein at least a part of the center and/or the intermediate layer is formed from the above rubber composition.

In the case that the golf ball of the present invention is a one-piece golf ball having a diameter of 42.67 mm to 42.82 mm, a compression deformation amount of the one-piece golf ball (an amount of compression of the golf ball in the compression direction thereof) when applying a load from 98 N as an initial load to 1275 N as a final load is preferably 2.3 mm or more, more preferably 2.4 mm or more, and even more preferably 2.5 mm or more, and is preferably 3.0 mm or less, more preferably 2.8 mm or less, and even more preferably 2.7 mm or less. If the compression deformation amount is 2.3 mm or more, the one-piece golf ball does not become too hard, and the better shot feeling is provided. If the compression deformation amount is 3.0 mm or less, the golf ball does not become too soft, and the better resilience is provided.

The following will describe a core in the case where the golf ball of the present invention is a two-piece golf ball, a three-piece golf ball, or a multi-piece golf ball.

The core of the golf ball of the present invention includes, for example, a single-layered core, and a multi-layered core consisting of a center and at least one intermediate layer covering the center. In the case of the multi-layered core, at least one layer of the core may be formed from the above rubber composition. However, the proportion of the volume of the layer formed from the above rubber composition, to the total core volume, is preferably 30% or more, more preferably 50% or more, and even more preferably 70% or more. Although all the layers of the multi-layered core may be formed from the above rubber composition, it is preferable that the center of the innermost layer is formed from the above rubber composition. It is noted that the core of the golf ball of the present invention is most preferably a single-layered core formed from the above rubber composition.

The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs, preferably the surface of the spherical center is evenly divided by the ribs. In one embodiment, the ribs are preferably formed as a part of the center in an integrated manner on the surface of the center, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

The core used in the golf ball of the present invention preferably has a diameter of 32.8 mm or larger, more preferably 33.6 mm or larger, and preferably has a diameter of 42.2 mm or smaller, more preferably 41.8 mm or smaller. If the diameter of the core is smaller than 32.8 mm, the cover must be made thicker than the desired thickness, resulting in the lowered resilience. On the other hand, if the diameter of the core is larger than 42.2 mm, the cover must be made thinner than the desired thickness, the durability of the cover may deteriorate.

In the case that the core has a diameter of from 32.8 mm to 42.2 mm, the compression deformation amount (deformation amount along the shrinkage direction) of the core when applying a load from 98 N as an initial load to 1275 N as a final load is preferably 2.0 mm or more, more preferably 2.5 mm or more, and even more preferably 3.0 mm or more, and is preferably 6.0 mm or less, more preferably 5.5 mm or less, and even more preferably 5.0 mm or less. If the compression deformation amount is 2.0 mm or more, the core does not become excessively hard and the shot feeling becomes better, while if the compression deformation amount is 6.0 mm or less, the core does not become excessively soft and the resilience is getting better.

Further, when the golf ball of the present invention is a three-piece golf ball or a multi-piece golf ball, the same material as a later-described cover material can be used as the material of the intermediate layer. Examples of the material of the intermediate layer include ionomer resins, thermoplastic polyamide resins, thermoplastic polyester resins, thermoplastic polyurethane resins, and thermoplastic polystyrene resins. In addition, for the intermediate layer, a weight adjusting agent such as barium sulfate or tungsten, an antioxidant, a pigment, or the like may be blended.

Next, the cover of the golf ball of the present invention will be explained. Examples of the cover material constituting the cover include, various resins such as an ionomer resin, a polyester resin, polyurethane resins like a thermoplastic urethane resin and a thermosetting urethane resin, and a polyamide resin; and various thermoplastic elastomers such as a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A")" available from BASF Japan Ltd, and thermoplastic polystyrene elastomers having a trade name "Rabalon (registered trademark)(e.g. "Rabalon T3221C")" commercially available from Mitsubishi Chemical Corporation, and the like. These cover materials may be used solely or in combination of two or more types thereof.

Examples of the ionomer resin include one prepared by neutralizing at least a part of carboxyl groups in a copolymer, composed of ethylene and α,β-unsaturated carboxylic acid having 3 to 8 carbon atoms with a metal ion; one prepared by neutralizing at least a part of carboxyl groups in a terpolymer composed of ethylene, α,β-unsaturated carboxylic acid having 3 to 8 carbons atoms, and α,β-unsaturated carboxylic acid ester with a metal ion; or a mixture of these two.

Metal ions for neutralization include: monovalent metal ions such as sodium ion, potassium ion, lithium ion, or the like; divalent metal ions such as zinc ion, calcium ion, magnesium ion, copper ion, manganese ion, or the like; trivalent metal ions such as aluminum ion, neodymium ion or the like. Among these metal ions, zinc ion is preferable, because the bonding strength of metal ion cluster is strong.

Specific examples of the ionomer resins include trade name "Himilan (registered trademark) (e.g. the binary copolymerized ionomer such as Himilan 1555 (Na), Himilan 1557 (Zn), Himilan 1605 (Na), Himilan 1706 (Zn), Himilan 1707 (Na), Himilan AM7311 (Mg), Himilan AM7329(Zn); and the ternary copolymerized ionomer such as Himilan 1856 (Na), Himilan 1855 (Zn))" commercially available from Du Pont-Mitsui Polychemicals Co., Ltd.

Further, examples include "Surlyn (registered trademark) (e.g. the binary copolymerized ionomer such as Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); and the ternary copolymerized ionomer such as Surlyn 6320 (Mg), Surlyn 8120 (Na), Surlyn 8320 (Na), Surlyn 9320 (Zn))" and the ternary copolymerized ionomer such as "HPF 1000 (Mg), HPF 2000 (Mg)" commercially available from E.I. du Pont de Nemours and Company.

Further, examples include "Iotek (registered trademark) (e.g. the binary copolymerized ionomer such as Iotek 8000 (Na), Iotek 8030 (Na), Iotek 7010 (Zn), Iotek 7030 (Zn); and the ternary copolymerized ionomer such as Iotek 7510 (Zn), Iotek 7520 (Zn))" commercially available from ExxonMobil Chemical Corporation. It is noted that Na, Zn, Li, and Mg described in the parentheses after the trade names indicate metal types of neutralizing metal ions for the ionomer resins.

The polyurethane resin or the polyurethane elastomer (hereinafter, merely referred to as "urethane resin") include a two-component curing type urethane resin obtained by curing an isocyanate group terminated urethane prepolymer with an aromatic polyamine or a thermoplastic urethane resin. The polyisocyanate component constituting the urethane resin is not limited, as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate (TMXDI), para-phenylene diisocyanate (PPDI); an alicyclic polyisocyanate or aliphatic polyisocyanate such as 4,4'-dicyclohexylmethane diisocyanate ($H_{12}MDI$), hydrogenated xylylenediisocyanate ($H_6XDI$), hexamethylene diisocyanate (HDI), isophorone diisocyanate (IPDI), and norbornene diisocyanate (NBDI). These may be used either alone or as a mixture of at least two of them. In view of improving the weather resistance, as the polyisocyanate component of the urethane resin, a non-yellowing type polyisocyanate such as TMXDI, XDI, HDI, $H_6XDI$, IPDI, $H_{12}MDI$ and NBDI is preferably used.

The polyol component constituting the urethane resin is not particularly limited as long as it has a plurality of hydroxyl groups, and such examples include a low-molecular weight polyol and a high-molecular weight polyol. Examples of the low-molecular weight polyol include a diol such as ethylene glycol, diethylene glycol, triethylene glycol, propanediol, dipropylene glycol, 1,3-butanediol, 1,4-butanediol, neopentyl glycol, 1,6-hexanediol; a triol such as glycerin, trimethylol propane, and hexanetriol. Examples of the high-molecular weight polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ϵ-caprolactone (PCL); a polycarbonate polyol such as polyhexamethylene carbonate; and an acrylic polyol. The above polyols may be used alone or as a mixture of at least two of them.

The aromatic polyamine has no limitation as long as it has at least two amino groups directly or indirectly bonded to an aromatic ring. Examples of the aromatic polyamine are a type such as phenylenediamine, tolylenediamine, and diethyltoluenediamine, wherein amino groups are directly bonded to an aromatic ring; a type such as dimethylthiotoluenediamine wherein amino groups are bonded to an aromatic ring via a sulfide bond; a type such as xylylenediamine wherein amino groups are bonded to an aromatic ring via a lower alkylene group; and 4,4'-diaminodiphenylmethane or derivatives thereof.

The cover of the golf ball of the present invention may contain a pigment component such as a white pigment (for example, titanium oxide or zinc oxide) and a blue pigment, a gravity adjusting agent such as calcium carbonate and barium sulfate, a dispersant, an antioxidant, an ultraviolet absorber, a light stabilizer, a fluorescent material or a fluorescent brightener, as long as the performance of the cover does not deteriorate.

The content of the white pigment (for example, titanium oxide) is preferably 0.5 part by mass or more, more preferably 1 part by mass or more, and is preferably 10 parts by mass or less, more preferably 8 parts by mass or less based on 100 parts by mass of the resin component. The white pigment in an amount of 0.5 part by mass or more can impart opacity to the cover, while the white pigment in an amount of more than 10 parts by mass may lower the durability of the cover.

In the present invention, the thickness of the cover of the golf ball is preferably 0.3 mm or more, more preferably 0.5 mm or more, even more preferably 1.0 mm or more, and is preferably 5.0 mm or less, more preferably 4.6 mm or less, even more preferably 2.5 mm or less. If the thickness of the cover is less than 0.3 mm, since the cover is too thin, the durability of the cover may deteriorate. If the thickness of the cover is more than 5.0 mm, the shot feeling of the golf ball may deteriorate.

When the golf ball of the present invention has a diameter in a range from 40 mm to 45 mm, a compression deformation amount of the golf ball (an amount of compression of the golf ball in the compression direction thereof) when applying a load from an initial load of 98 N to a final load of 1275 N to the golf ball is preferably 2.0 mm or more, more preferably 2.4 mm or more, even more preferably 2.5 mm or more, most preferably 2.8 mm or more, and is preferably 4.0 mm or less, more preferably 3.8 mm or less, even more preferably 3.6 mm or less. If the compression deformation amount is 2.0 mm or more, the golf ball does not become excessively hard, and thus exhibits the good shot feeling. On the other hand, if the compression deformation amount is 4.0 mm or less, the resilience is enhanced.

The method for producing a golf ball of the present invention comprises the steps of blending (d) the organic sulfur compound including at least one represented by the above formula (1) to (3), (a) a base rubber, (b) a co-crosslinking agent, and (c) a crosslinking initiator to prepare a rubber composition, and forming at least a part of a constituting member of the golf ball from the rubber composition. In a preferable embodiment, the method for producing a golf ball of the present invention comprises the steps of blending (d) the organic sulfur compound including at least one represented by the above formula (1) to (3), (a) a base rubber, (b) a co-crosslinking agent, and (c) a crosslinking initiator to prepare a rubber composition, forming at least one layer of a core from the rubber composition, and forming a cover covering the core.

The blending of the organic sulfur compound represented by the above formula (1) to (3), the base rubber, the co-crosslinking agent, and the crosslinking initiator to prepare the rubber composition is carried out by kneading homogenously using, for example, a kneader like a kneading roll.

The step of forming a part of the constituting member of the golf ball from the rubber composition is conducted by molding the kneaded rubber composition in molds. The conditions of molding is not limited and the molding is preferably carried out for 10 to 60 minutes at the temperature of 130° C. to 200° C. under the pressure of 2.9 MPa to 11.8 MPa. For example, the rubber composition is preferably heated at the temperature of 130° C. to 200° C. for 10 to 60 minutes, or the rubber composition is preferably heated at two steps, for example, for 20 to 40 minutes at the temperature of 130° C. to 150° C., and continuously for 5 to 15 minutes at the temperature of 160° C. to 180° C.

In the case of the one-piece golf ball, the golf ball body is formed from the above rubber composition. In the case of the multi-layered core, at least one layer of the center and the intermediate layer is formed from the above rubber composition. For example, only the center is formed from the above rubber composition or both of the center and the intermediate layer are formed from the above rubber composition.

One example of the process for forming the intermediate layer is to cover the center with the intermediate layer composition to form an intermediate layer. The process for forming the intermediate layer is not particularly limited. In one embodiment, the intermediate layer composition is molded into hemispherical half shells in advance, and then the center is covered with two half shells and press-molded at the temperature of 130° C. to 170° C. for 1 to 5 minutes. In another embodiment, the intermediate layer composition is injection-molded directly onto the center so as to cover the center.

An embodiment for molding a cover is not particularly limited, and includes an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding) or an embodiment which comprises injection molding the cover composition directly onto the core.

After the cover is molded, the mold is opened and the golf ball body is taken out from the mold, and as necessary, the golf ball body is preferably subjected to surface treatments such as deburring, cleaning, and sandblast. If desired, a paint film or a mark may be formed. The paint film preferably has a thickness of, but not limited to, 5 μm or larger, and more preferably 7 μm or larger, and preferably has a thickness of 50 μm or smaller, more preferably 40 μm or smaller, and even more preferably 30 μm or smaller. If the thickness is smaller than 5 μm, the paint film is easy to wear off due to continued use of the golf ball, and if the thickness is larger than 50 μm, the effect of the dimples is reduced, resulting in deteriorating flying performance of the golf ball.

EXAMPLES

Hereinafter, the present invention will be described in detail by way of example. The present invention is not limited to examples described below. Various changes and modifications can be made without departing from the spirit and scope of the present invention.

[Evaluation]

(1) Compression Deformation Amount (mm)

A compression deformation amount of the golf ball or core (a shrinking amount of the golf ball or core in the compression direction thereof), when applying a load from 98 N as an initial load to 1275 N as a final load to the golf ball or core, was measured.

(2) Coefficient of Restitution

A 198.4 g of metal cylindrical object was allowed to collide with each golf ball at a speed of 40 m/sec, and the speeds of the cylindrical object and the golf ball before and after the collision were measured. Based on these speeds and the mass of each object, coefficient of restitution for each golf ball was calculated. The measurement was conducted by using twelve of each golf ball, and the average value was regarded as the coefficient of restitution for the golf ball. The coefficient of restitution of golf ball No. 25 was defined as an index of 100.0, and the coefficient of restitution of each golf ball was represented by converting the coefficient of restitution of each golf ball into this index.

[Production of Cores]

The rubber compositions having formulations shown in Tables 1 to 4 were kneaded with a kneading roll and heat-pressed in upper and lower molds, each having a hemispherical cavity, at a temperature of 170° C. for 20 minutes to obtain the spherical cores having a diameter of 39.6 mm. The formulations of the core were adjusted to make the core have the same compression deformation amount (4.2 mm). Barium sulfate was added in an appropriate amount so that the resultant core has a mass of 37.8 g.

TABLE 1

| | Rubber composition No. | | | | | | | |
|---|---|---|---|---|---|---|---|---|
| | 1 | 2 | 3 | 4 | 5 | 6 | 7 | 8 |
| Polybutadiene rubber | 100 | 100 | 100 | 100 | 100 | 100 | 100 | 100 |
| Zinc acrylate | 27.5 | 27.5 | 27.5 | 27.5 | 27.5 | 27.5 | 27.5 | 27.5 |
| Barium sulfate | Appropriate amount | Appropriate amount | Appropriate amount | Appropriate amount | Appropriate amount | Appropriate amount | Appropriate amount | Appropriate amount |
| Zinc oxide | 5 | 5 | 5 | 5 | 5 | 5 | 5 | 5 |
| Dicumyl peroxide | 1.1 | 1.1 | 1.1 | 1.1 | 1.1 | 1.1 | 1.1 | 1.1 |
| Bis(2,4,6-tirs(chloroformylcarboxy)phenyl)Disulfide | 0.86 | — | — | — | — | — | — | — |
| Bis(2,6-bis(chloroformylcarboxy)phenyl)Disulfide | — | 0.64 | — | — | — | — | — | — |
| Bis(2,3,4-tris(chloroformylcarboxy)phenyl)Disulfide | — | — | 0.86 | — | — | — | — | — |
| Bis(pentakis(chloroformylcarboxy)phenyl)Disulfide | — | — | — | 1.28 | — | — | — | — |
| Bis(2,4,6-tris(acetoxycarbonyl)phenyl)Disulfide | — | — | — | — | 0.73 | — | — | — |
| Bis(2,6-bis(acetoxycarbonyl)phenyl)Disulfide | — | — | — | — | — | 0.56 | — | — |
| Bis(2,3,4-tris(acetoxycarbonyl)phenyl)Disulfide | — | — | — | — | — | — | 0.73 | — |
| Bis(pentakis(acetoxycarbonyl)phenyl)disulfide | — | — | — | — | — | — | — | 1.08 |
| Coefficient of Restitution of golf ball | 105.3 | 104.8 | 104.4 | 104.3 | 104.8 | 104.3 | 104 | 103.9 |

Formulation: parts by mass

TABLE 2

| | Rubber composition No. | | | | | | | |
|---|---|---|---|---|---|---|---|---|
| | 9 | 10 | 11 | 12 | 13 | 14 | 15 | 16 |
| Polybutadiene rubber | 100 | 100 | 100 | 100 | 100 | 100 | 100 | 100 |
| Zinc acrylate | 27.5 | 27.5 | 27.5 | 27.5 | 27.5 | 27.5 | 27.5 | 27.5 |
| Barium sulfate | Appropriate amount | Appropriate amount | Appropriate amount | Appropriate amount | Appropriate amount | Appropriate amount | Appropriate amount | Appropriate amount |
| Zinc oxide | 5 | 5 | 5 | 5 | 5 | 5 | 5 | 5 |
| Dicumyl peroxide | 1.1 | 1.1 | 1.1 | 1.1 | 1.1 | 1.1 | 1.1 | 1.1 |
| 2,4,6-tirs(chloroformylcarboxy)thiophenol | 0.86 | — | — | — | — | — | — | — |
| 2,6-bis(chloroformylcarboxy)thiophenol | — | 0.64 | — | — | — | — | — | — |
| 2,3,4-tris(chloroformylcarboxy)thiophenol | — | — | 0.86 | — | — | — | — | — |
| Pentakis(chloroformylcarboxy)thiophenol | — | — | — | 1.28 | — | — | | |
| 2,4,6-tris(acetoxycarbonyl)thiophenol | — | — | — | — | 0.73 | — | — | — |
| 2,6-bis(acetoxycarbonyl)thiophenol | — | — | — | — | — | 0.56 | — | — |
| 2,3,4-tris(acetoxycarbonyl)thiophenol | — | — | — | — | — | — | 0.73 | — |
| Pentakis(acetoxycarbonyl)thiophenol | — | — | — | — | — | — | — | 1.08 |
| Coefficient of Restitution of golf ball | 105.5 | 104.7 | 104.5 | 104.0 | 104.7 | 104.6 | 104.1 | 104.1 |

Formulation: parts by mass

TABLE 3

| | Rubber composition No. | | | | | | | |
|---|---|---|---|---|---|---|---|---|
| | 17 | 18 | 19 | 20 | 21 | 22 | 23 | 24 |
| Polybutadiene rubber | 100 | 100 | 100 | 100 | 100 | 100 | 100 | 100 |
| Zinc acrylate | 27.5 | 27.5 | 27.5 | 27.5 | 27.5 | 27.5 | 27.5 | 27.5 |
| Barium sulfate | Appropriate amount | Appropriate amount | Appropriate amount | Appropriate amount | Appropriate amount | Appropriate amount | Appropriate amount | Appropriate amount |
| Zinc oxide | 5 | 5 | 5 | 5 | 5 | 5 | 5 | 5 |
| Dicumyl peroxide | 1.1 | 1.1 | 1.1 | 1.1 | 1.1 | 1.1 | 1.1 | 1.1 |
| 2,4,6-tris(chloroformylcarboxy)thiophenol zinc salt | 0.92 | — | — | — | — | — | — | — |
| 2,6-bis(chloroformylcarboxy)thiophenol zinc salt | — | 0.71 | — | — | — | — | — | — |
| 2,3,4-tris(chloroformylcarboxy)thiophenol zinc salt | — | — | 0.92 | — | — | — | — | — |
| Pentakis(chloroformylcarboxy)thiophenol zinc salt | — | — | — | 1.35 | — | — | — | — |
| 2,4,6-tris(acetoxycarbonyl)thiophenol zinc salt | — | — | — | — | 0.8 | — | — | — |
| 2,6-bis(acetoxycarbonyl)thiophenol zinc salt | — | — | — | — | — | 0.63 | — | — |
| 2,3,4-tris(acetoxycarbonyl)thiophenol zinc salt | — | — | — | — | — | — | 0.8 | — |
| Pentakis(acetoxycarbonyl)thiophenol zinc salt | — | — | — | — | — | — | — | 1.14 |
| Coefficient of Restitution of golf ball | 105.0 | 104.8 | 104.7 | 103.8 | 104.5 | 104.4 | 103.8 | 103.6 |

Formulation: parts by mass

TABLE 4

| | Rubber composition No. | | | | | | | | |
|---|---|---|---|---|---|---|---|---|---|
| | 25 | 26 | 27 | 28 | 29 | 30 | 31 | 32 | 33 |
| Polybutadiene rubber | 100 | 100 | 100 | 100 | 100 | 100 | 100 | 100 | 100 |
| Zinc acrylate | 27.5 | 27.5 | 27.5 | 27.5 | 27.5 | 27.5 | 27.5 | 27.5 | 27.5 |
| Zinc oxide | 5 | 5 | 5 | 5 | 5 | 5 | 5 | 5 | 5 |
| Barium sulfate | Appropriate amount | Appropriate amount | Appropriate amount | Appropriate amount | Appropriate amount | Appropriate amount | Appropriate amount | Appropriate amount | Appropriate amount |
| Dicumyl peroxide | 0.3 | 1.5 | 0.6 | 1.3 | 0.7 | 1.1 | 1.20 | 2.0 | 1.7 |
| Bis(pentabromopheny)disulfide | — | 1.01 | — | — | — | — | — | — | — |
| Pentakis(trifluoromethyl)thiophenol | — | — | 0.9 | — | — | — | — | — | — |
| 2,4,6-tris(trifluoromethyl)thiophenol | — | — | — | 0.63 | — | — | — | — | — |
| 3,5-bis(trifluoromethyl)thiophenol | — | — | — | — | 0.49 | — | — | — | — |
| Pentachlorothiophenol | — | — | — | — | — | 0.56 | — | — | — |
| 2,3,4-trichlorothiophenol | — | — | — | — | — | — | 0.43 | — | — |
| 2,6-dichlorothiophenol | — | — | — | — | — | — | — | 0.36 | — |

TABLE 4-continued

| | Rubber composition No. | | | | | | | | |
|---|---|---|---|---|---|---|---|---|---|
| | 25 | 26 | 27 | 28 | 29 | 30 | 31 | 32 | 33 |
| 4-chlorothiophenol | — | — | — | — | — | — | — | — | 0.29 |
| Coefficient of Restitution of golf ball | 100.0 | 102.7 | 101.6 | 103.0 | 101.9 | 103.2 | 102.3 | 102.6 | 101.3 |

Formulation: parts by mass

Polybutadiene rubber: "BR-730 (high-cis polybutadiene)" manufactured by JSR Corporation (cis-1,4 bond content=96 mass %, 1,2-vinyl bond content=1.3 mass %, Mooney viscosity ($ML_{1+4}$ (100° C.))=55, molecular weight distribution (Mw/Mn)=3).

Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Dicumyl peroxide: "Percumyl (registered trademark) D" manufactured by NOF Corporation.

(2) Forming the Cover

The cover material shown in Table 5 was mixed using a twin-screw kneading extruder to obtain the cover composition in the form of pellet. The extrusion was conducted in the following conditions: screw diameter=45 mm, screw revolutions=200 rpm, and screw L/D=35. The cover composition was heated to from 200° C. to 230° C. at the die position of the extruder. The cover composition thus prepared was directly injection-molded onto the core, thereby producing golf balls having a core and a cover (thickness: 1.45 mm) covering the core. The coefficient of restitution of the obtained golf ball was evaluated. The results were also shown in Tables 1 to 4.

TABLE 5

| Cover material | Amount (parts) |
|---|---|
| Himilan 1706 | 30 |
| Himilan 1707 | 30 |
| Himilan 1605 | 40 |
| Titanium oxide | 2 |
| Barium sulfate | 2 |

Note on table 3:

Himilan 1706: an ionomer resin of a zinc ion-neutralized ethylene-methacrylic acid copolymer, available from MITSUI-DUPONT POLYCHEMICAL Himilan 1707: an ionomer resin of a sodium ion-neutralized ethylene-methacrylic acid copolymer, available from MITSUI-DUPONT POLYCHEMICAL Himilan 1605: an ionomer resin of a sodium ion-neutralized ethylene-methacrylic acid copolymer, available from MITSUI-DUPONT POLYCHEMICAL The results of tables 1 to 4 shows that the golf balls using the organic sulfur compound including at least one organic sulfur compound represented by the above formulae (1) to (3) have high resilience.

The golf ball of the present invention has high resilience. This application is based on Japanese Patent application No. 2010-278258 filed on Dec. 14, 2010, the contents of which are hereby incorporated by reference.

The invention claimed is:

1. A golf ball having a constituting member, wherein at least a part of the constituting member is formed from a rubber composition containing (a) a base rubber, (b) a co-crosslinking agent, (c) a crosslinking initiator, and (d) an organic sulfur compound including at least one represented by following formulae (1) to (3);

(1)

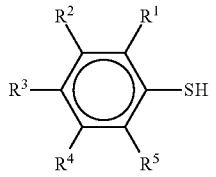

in formula (1), $R^1$ to $R^5$ each independently represent $COOR^{11}$ or H, and at least one of $R^1$ to $R^5$ is $COOR^{11}$, and $COOR^{11}$ is COOX, COOCOX, or $COOCOR^{12}$, wherein X is any one of Br, Cl, or F and $R^{12}$ is an alkyl group having a carbon number of 1 to 17 where one or more hydrogens of the alkyl group are optionally substituted;

(2)

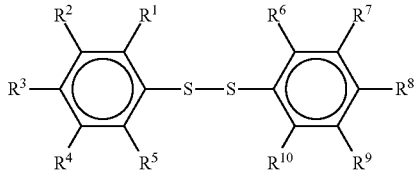

in formula (2), $R^1$ to $R^{10}$ each independently represent $COOR^{11}$ or H, and at least one of $R^1$ to $R^5$ and at least one of $R^6$ to $R^{10}$ are $COOR^{11}$, and $COOR^{11}$ is COOX, COOCOX, or $COOCOR^{12}$, wherein X is any one of Br, Cl, or F and $R^{12}$ is an alkyl group having a carbon number of 1 to 17 where one or more hydrogens of the alkyl group are optionally substituted;

(3)

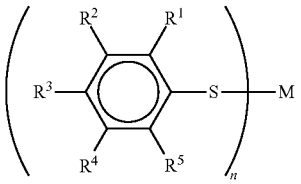

in formula (3), $R^1$ to $R^5$ each independently represent $COOR^{11}$ or H, and at least one of $R^1$ to $R^5$ is $COOR^{11}$, and $COOR^{11}$ is COOX, COOCOX, or $COOCOR^{12}$, wherein X is any one of Br, Cl, or F and $R^{12}$ is an alkyl group having a carbon number of 1 to 17 where one or more hydrogens of the alkyl group are optionally substituted; n is a natural number equal to or larger than 1, and M represents a metal atom having a valence equal to or larger than 1.

2. The golf ball according to claim 1, wherein two to four of $R^1$ to $R^5$ are $COOR^{11}$ in the formulae (1) and (3).

3. The golf ball according to claim 1, wherein two to four of $R^1$ to $R^5$ and two to four of $R^6$ to $R^{10}$ are $COOR^{11}$ in the formula (2).

4. The golf ball according to claim 1, wherein $COOR^{11}$ is attached at ortho position or para position to a sulfur bond.

5. The golf ball according to claim 1, wherein $COOR^{11}$ is COOCOCl.

6. The golf ball according to claim 1, wherein the golf ball is a two-piece golf ball comprising a core and a cover covering the core, wherein the core is formed from the rubber composition.

7. The golf ball according to claim 1, wherein the golf ball is a multi-piece golf ball comprising a core having a center and at least one intermediate layer covering the center, and a cover covering the core, wherein at least a part of the center and/or the intermediate layer is formed from the rubber composition.

8. The golf ball according to claim 1, wherein the golf ball is a one-piece golf ball comprising a golf ball body, wherein the golf ball body is formed from the rubber composition.

9. The golf ball according to claim 1, wherein the organic sulfur compound represented by the formula (1) includes at least one member selected from the group consisting of 2,4,6-tris(chloroformylcarboxy)thiophenol, 2,6-bis(chloroformylcarboxy)thiophenol, 2,3,4-tris(chloroformylcarboxy)thiophenol, pentakis(chloroformylcarboxy)thiophenol, 2,4,6-tris(acetoxycarbonyl)thiophenol, 2,6-bis(acetoxycarbonyl)thiophenol, 2,3,4-tris(acetoxycarbonyl)thiophenol, pentakis(acetoxycarbonyl)thiophenol, and 2,4,6-tris(trichloromethylformylcarboxy)thiophenol.

10. The golf ball according to claim 1, wherein the organic sulfur compound represented by the formula (2) includes at least one member selected from the group consisting of bis(2,4,6-tris(chloroformylcarboxy)phenyl)disulfide, bis(2,6-bis(chloroformylcarboxy)phenyl)disulfide, bis(2,3,4-tris(chloroformylcarboxy)phenyl)disulfide, bis(pentakis(chloroformylcarboxy)phenyl)disulfide, bis(2,4,6-tris(acetoxycarbonyl)phenyl)disulfide, bis(2,6-bis(acetoxycarbonyl)phenyl)disulfide, bis(2,3,4-tris(acetoxycarbonyl)phenyl)disulfide, bis(pentakis(acetoxycarbonyl)phenyl)disulfide, and bis(2,4,6-tris(trichloromethylformylcarboxy)phenyl)disulfide.

11. The golf ball according to claim 1, wherein the organic sulfur compound represented by the formula (3) includes a metal salt of at least one member selected from the group consisting of 2,4,6-tris(chloroformylcarboxy)thiophenol, 2,6-bis(chloroformylcarboxy)thiophenol, 2,3,4-tris(chloroformylcarboxy)thiophenol, pentakis(chloroformylcarboxy)thiophenol, 2,4,6-tris(acetoxycarbonyl)thiophenol, 2,6-bis(acetoxycarbonyl)thiophenol, 2,3,4-tris(acetoxycarbonyl)thiophenol, pentakis(acetoxycarbonyl)thiophenol, and 2,4,6-tris(trichloromethylformylcarboxy)thiophenol.

12. A golf ball having a constituting member, wherein at least one part of the constituting member is formed from a rubber composition containing (a) a base rubber, (b) a co-crosslinking agent, (c) a crosslinking initiator, and (d) an organic sulfur compound including at least one represented by following formulae (4) to (6);

(4)

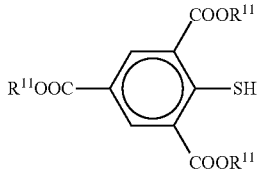

(5)

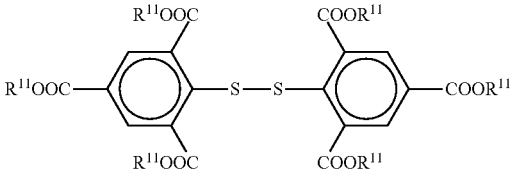

(6)

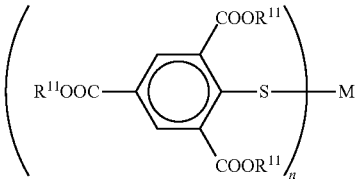

in formulae (4) to (6), $COOR^{11}$ is COOX, COOCOX, or $COOCOR^{12}$, wherein X is any one of Br, Cl, or F and $R^{12}$ is an alkyl group having a carbon number of 1 to 17 where one or more hydrogens of the alkyl group are optionally substituted; in formula (6), n is a natural number equal to or larger than 1, and M represents a metal atom having a valence equal to or larger than 1.

13. The golf ball according to claim 12, wherein $COOR^{11}$ is COOCOCl.

* * * * *